US007097476B2

(12) United States Patent
Morikawa et al.

(10) Patent No.: US 7,097,476 B2
(45) Date of Patent: Aug. 29, 2006

(54) CONNECTOR WITH MOVABLE MEMBER FOR ASSISTING CONNECTION WITH A MATING CONNECTOR

(75) Inventors: Takashi Morikawa, Yokkaichi (JP); Kazunori Yamashita, Yokkaichi (JP)

(73) Assignee: Sumitomo Wiring Systems, Ltd, (JP)

( * ) Notice: Subject to any disclaimer, the term of this patent is extended or adjusted under 35 U.S.C. 154(b) by 0 days.

(21) Appl. No.: 11/018,951

(22) Filed: Dec. 20, 2004

(65) Prior Publication Data

US 2005/0136714 A1 Jun. 23, 2005

(30) Foreign Application Priority Data

Dec. 22, 2003 (JP) ..... 2003-425179

(51) Int. Cl.
*H01R 13/62* (2006.01)

(52) U.S. Cl. ..... 439/157

(58) Field of Classification Search ..... 439/157, 439/347

See application file for complete search history.

(56) References Cited

U.S. PATENT DOCUMENTS 5,888,080 A * 3/1999 Maejima ..... 439/157
5,902,141 A * 5/1999 Iwahori ..... 439/157
6,036,509 A * 3/2000 Maejima ..... 439/157
6,155,850 A * 12/2000 Martin et al. ..... 439/157
6,244,880 B1 * 6/2001 Fukase et al. ..... 439/157
6,254,407 B1 * 7/2001 Burns ..... 439/157

FOREIGN PATENT DOCUMENTS

JP 10-172651 6/1998

* cited by examiner

*Primary Examiner*—Tulsidas C. Patel
*Assistant Examiner*—Harshad Patel
(74) *Attorney, Agent, or Firm*—Gerald E. Hespos; Anthony J. Casella

(57) ABSTRACT

A frame (70) is formed with a slider accommodating space (75) and a housing accommodating space (74) that are partitioned by inner walls (78). A slider (50) is formed with cam grooves (51) to face the housing accommodating space (74), and a male housing (30) is pulled to a connection position by a movement of the slider (50) in a direction substantially normal to a connecting direction with cam pins (31) of the male housing (30) engaged with the cam grooves (51). The inner walls (78) have thinned portions (79) reducing the thickness of the inner walls (78). Surrounding walls (19) of receptacles (13) of auxiliary housings (11) enter the thinned portions (19) to arrange the surrounding walls (19) in proximity to main portions (53) of the slider (50).

18 Claims, 14 Drawing Sheets

CONNECTOR WITH MOVABLE MEMBER FOR ASSISTING CONNECTION WITH A MATING CONNECTOR

BACKGROUND OF THE INVENTION

1. Field of the Invention

The invention relates to a connector that uses a movable member to complete a connecting operation with a small connecting force.

2. Description of the Related Art

Japanese Unexamined Patent Publication No. H10-172651 discloses a connector that has two auxiliary housings, a frame for accommodating the auxiliary housings, and a slider mounted to the frame. The frame has left and right rectangular chambers that are partitioned by a middle partition wall. The chambers are hollow in a connecting direction and are configured to accommodate the auxiliary housings. Covers are arranged to face each other at the outer sides of upper and lower walls of the frame, and slider accommodating spaces are defined between the covers and the upper and lower walls of the frame for accommodating the slider.

The slider has cam grooves that engage cam pins of a mating housing. The slider can be pushed into the frame in a direction normal to the connecting direction while the cam pins engage the cam grooves. Thus, the mating housing is pulled into the frame by a cam action.

The upper and lower walls of the frame of the above-described connector are arranged outside the auxiliary housings. Additionally, the slider accommodating spaces are defined outside the upper and lower walls of the frame, and the covers are arranged outside the slider accommodating spaces. Thus, the connector tends to have a large height, and it has been difficult to meet a request to shorten the height of the connector.

The present invention was developed in view of the above problem and an object thereof is to shorten the height of a connector.

SUMMARY OF THE INVENTION

The invention relates to a connector with first and second housings that are connectable with each other. The connector also has a frame and a movable member. The frame has a movable member accommodating space for permitting entry of the movable member and a housing accommodating space for permitting entry of the housings. The frame also has an inner wall between the housing accommodating space and the movable member accommodating space. Movement of the movable member performs or assists the connection of the housings. The inner wall has at least one thinned portion reducing the thickness of the inner wall. An outer wall of the first housing enters the thinned portion to approach or contact the movable member in the movable member accommodating space. Thus, the height of the connector can be reduced by as much as the thickness of the inner wall is reduced.

The movable member preferably has at least one cam that substantially faces the housing accommodating space. The second housing is assisted in its movement to a connection position by a movement of the movable member at an angle to a connecting direction while at least one mating cam on the second housing engages the cam of the movable member.

The movable member preferably is a slider.

The thinned portion preferably penetrates the inner wall, and the outer wall of the first housing and the inner wall are substantially flush with each other at surfaces defining the movable member accommodating space. Thus, the insertion stability of the movable member during insertion into the movable member accommodating space is improved.

The first housing preferably includes a substantially tubular receptacle for receiving the second housing.

The outer wall of the first housing preferably is formed by at least one surrounding wall of the receptacle. The surrounding wall of the receptacle and the inner wall preferably are substantially flush with each other at a side of surfaces defining the housing accommodating space.

The first housing preferably includes a tubular receptacle for receiving the second housing, the outer wall of the first housing is formed by a surrounding wall of the receptacle, and the surrounding wall of the receptacle and the inner wall are substantially flush with each other at a side of surfaces defining the housing accommodating space. Therefore, the second housing moving from the inner wall toward the receptacle can be connected smoothly.

The first housing preferably comprises two or more auxiliary housings that are insertable into the frame one substantially after the other.

One or more guides preferably extend substantially along an inserting direction of the housing into the frame, on or in the housing and are engageable with one or more guidable portions in the frame.

Guides preferably are provided on each of the auxiliary housings, and the auxiliary housing inserted first into the frame are narrower than those of the auxiliary housings inserted later into the frame.

The guidable portions at the back side of the frame preferably are narrow grooves, and those closer to the insertion opening of the frame preferably are wider grooves.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
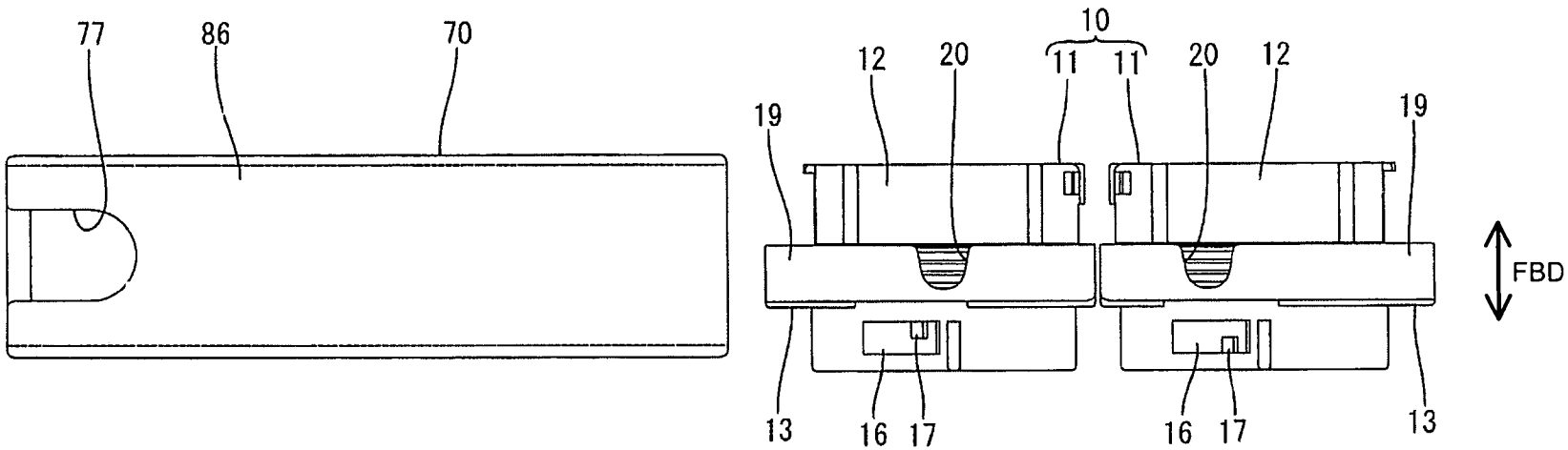
FIG. 1 is a plan view showing a frame and auxiliary housings according to one embodiment of the invention.

A connector according to the invention is described with reference to FIGS. 1 to 14. The connector has a female housing 10, a male housing 30, a slider 50, and a frame 70. The female housing 10 is comprised of two auxiliary housings 11. The slider 50 is mounted in the frame 70 at a partial locking position. The auxiliary housings 11 also are mounted in the frame 70 and the male housing 30 is positioned to face the auxiliary housings 11. The slider 50 then is pushed in an operating direction OD towards a full locking position. As a result, a cam action is displayed between cam pins 31 on the male housing 30 and cam grooves 51 in the slider 50 to pull the male housing 30 into connection with the auxiliary housings 11. In the following description, sides of the female and male housings 10, 30 connected together are referred to as the front side.

Figure 10:
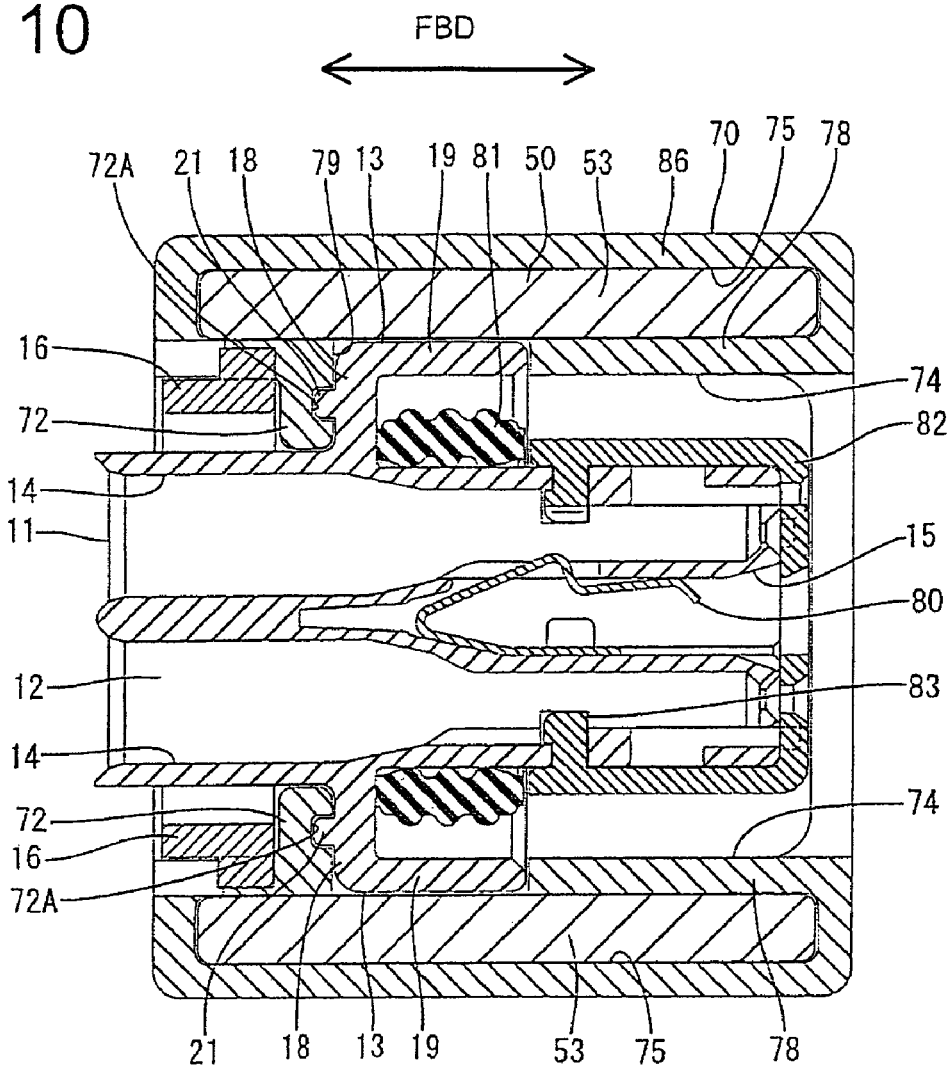
FIG. 10 is an enlarged section along 10—10 of FIG. 8.
Figure 11:
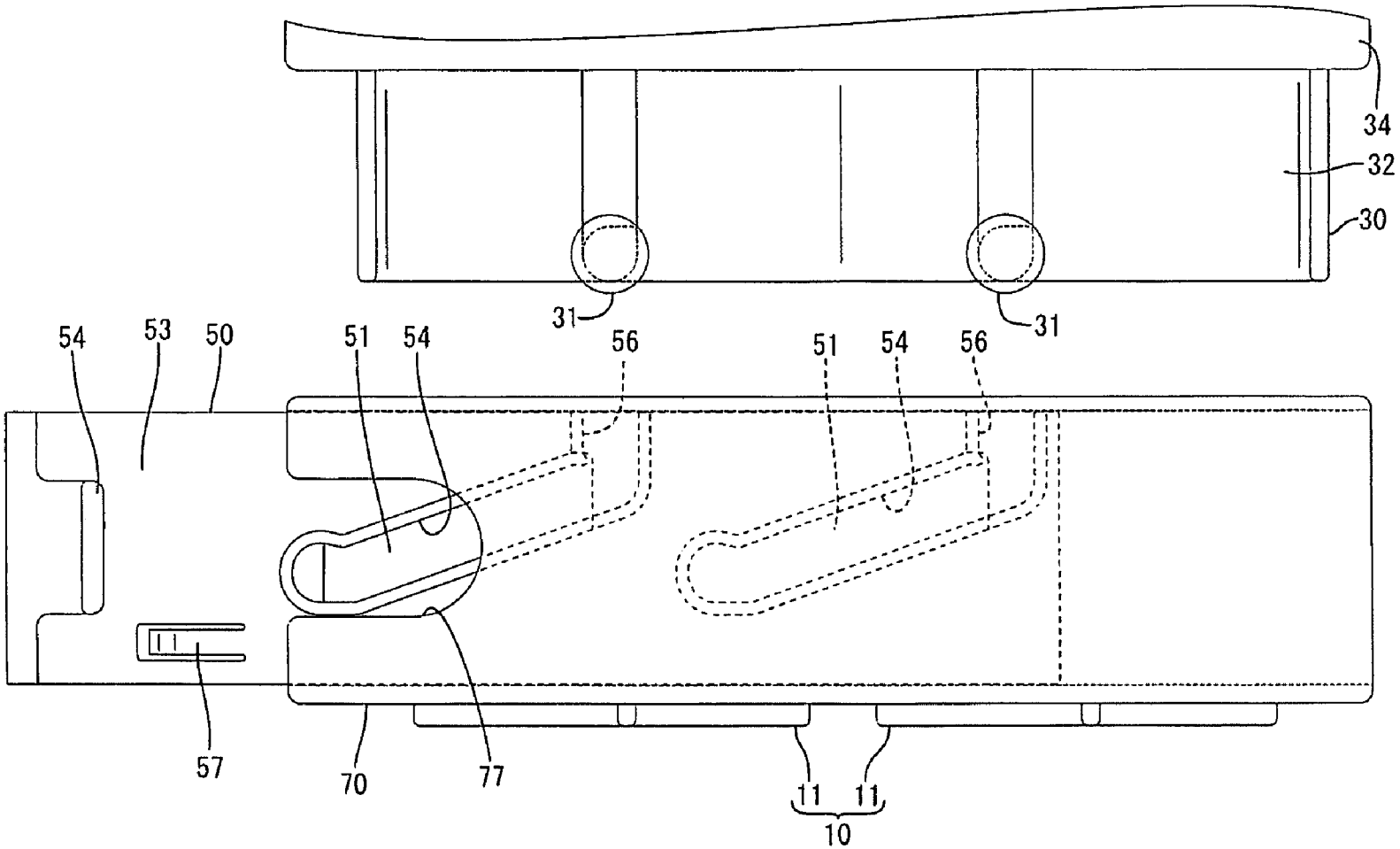
FIG. 11 is a plan view showing a state before a male housing is assembled into the frame.

Each auxiliary housing 11 is made e.g. of a synthetic resin and has a substantially block-shaped main body 12. A substantially rectangular tubular receptacle 13 is coupled to main body 12 at an intermediate portion along forward and backward directions FBD. Cavities 14 are arrayed in the main body 12 at upper and lower stages, and female terminal fittings (not shown) are inserted into the cavities 14 from behind. As shown in FIG. 10, forwardly open shorting-terminal mount holes 15 are formed between two upper and lower cavities 14 of the main body 12 and shorting terminals 80 are accommodated therein. Each shorting terminal 80 is connectable with two adjacent female terminal fittings so as not to create any potential difference between these female terminal fittings.

Figure 7:
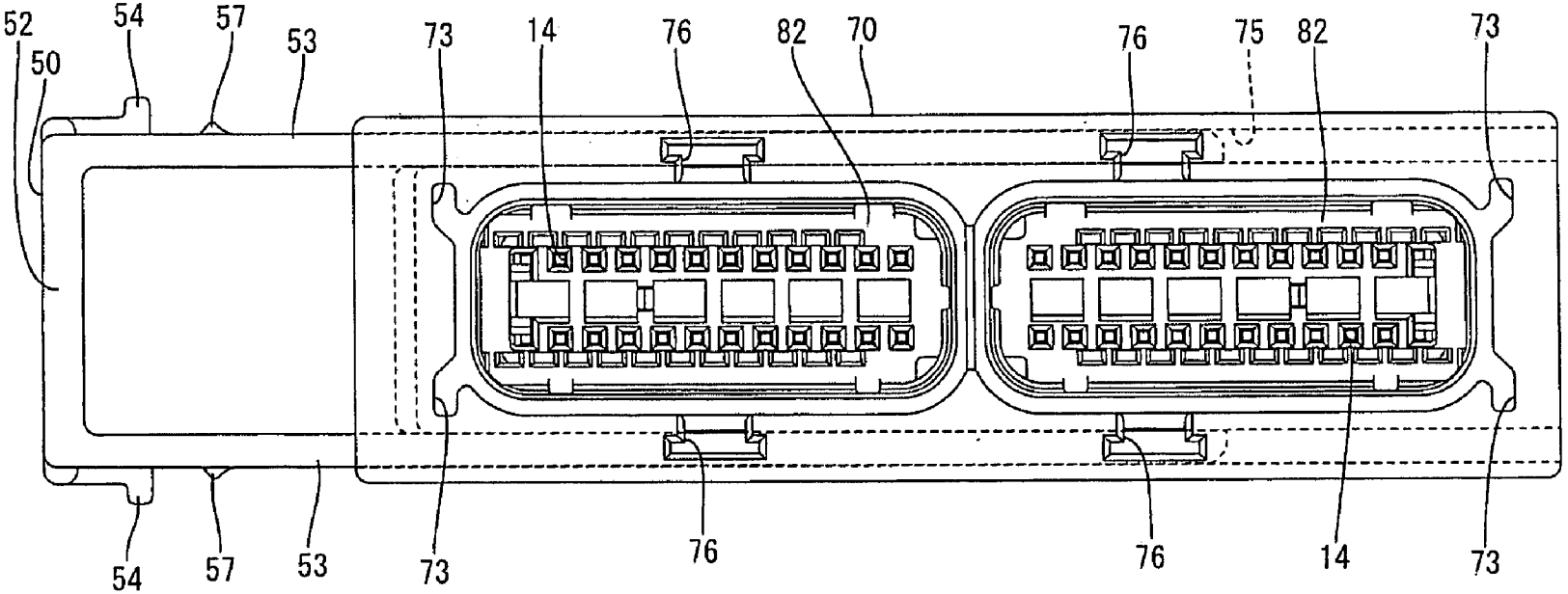
FIG. 7 is a front view showing the slider at a partial locking position.

A resilient or rubber member 81 is mounted around the outer peripheral surface of the main body 12 at a position corresponding to the receptacle 13. A receptacle 32 of the male housing 30 is fittable between the receptacle 13 and the housing main body 12, and the rubber member 81 provides sealing between the male housing 30 and the housing main body 12. A retainer 82 is mounted on the outer peripheral surface of the housing main body 12 before the receptacle 13, as shown in FIGS. 7 and 10. The retainer 82 is displaceable between a partial locking position where insertion and withdrawal of the female terminal fittings are permitted and a full locking position where the female terminals are retained by the retainer 82. Each retainer has a locking section 83 that is substantially distanced from the respective cavity 14 when the retainer 82 is at the partial locking position. However, each locking section 83 is in the respective cavity 14 to engage the respective female terminal fitting when the retainer 82 is at the full locking position. The retainer 82 is a side type retainer, and is slidable along transverse direction intersecting a direction of insertion and withdrawal of the female terminal fittings.

Figure 4:
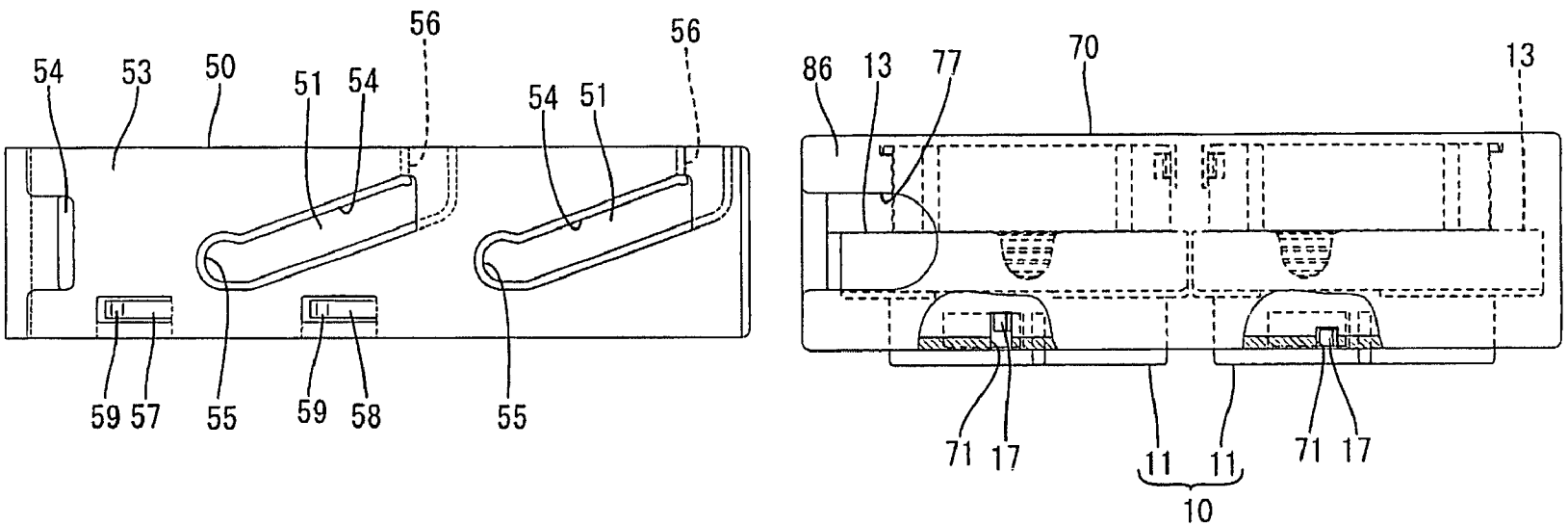
FIG. 4 is a plan view showing a slider and the frame having the auxiliary housings accommodated therein.
Figure 8:
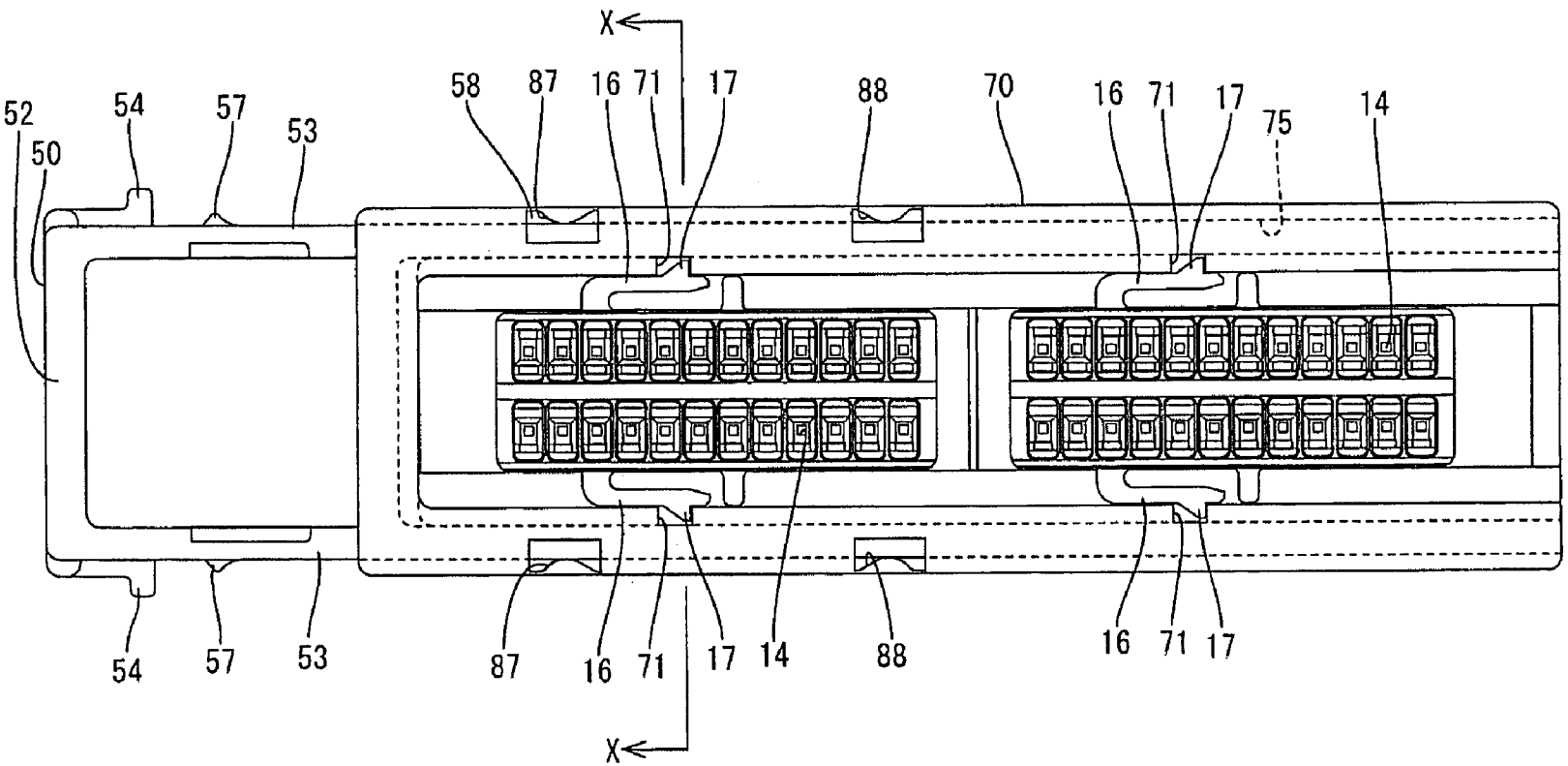
FIG. 8 is a rear view showing the slider at the partial locking position.

Each auxiliary housing 11 is mounted into the frame 70 in a transverse direction substantially normal to a connecting direction. Locks 16 are provided on the main body 12 behind the receptacle 13 and are resiliently engageable with engaging portions 71 in the frame 70. As shown in FIG. 8, the locks 16 are provided at two substantially symmetrical positions on the upper and lower walls of the main body 12. The locks 16 have base ends connected at positions of the main body 12 displaced toward one widthwise end. The locks 16 then extend from the base ends substantially along an inserting direction ID into the frame 70 and are resiliently deformable. A lock projection 17 is provided at an extending end of each lock 16. As shown in FIGS. 1 and 4, the lock projections 17 are provided at different respective positions in the two auxiliary housings 11 and are not on the same axis extending along the inserting direction ID into the frame 70. Specifically, the lock projections 17 are at the front side of the locks 16 with respect to a width direction intersecting the inserting direction ID into the frame 70 for the auxiliary housing 11 inserted first into the frame 70. However, the lock projections 17 are at the rear side of the locks 16 with respect to the width direction for the auxiliary housing 11 inserted later into the frame 70. Engaging portions 71 are formed in the frame 70 at positions substantially corresponding to the respective lock projections 17. By displacing the positions of the lock projections 17 substantially along forward and backward directions FBD, the lock projections 17 of the auxiliary housing 11 inserted first do not fit into the engaging portions 71 for the auxiliary housing 11 inserted later.

As shown in FIG. 10, the receptacle 13 has a standing wall 18 connected with the housing main body 12. A surrounding wall 19 projects forward from the extending end of the standing wall 18. Thus, the surrounding wall 19 is spaced from and at least partly surrounds the housing main body 12. The surrounding wall 19 of the receptacle 13 has a dimension along forward and backward directions FBD substantially corresponding to the length of the rubber member 81 mounted on the housing main body 12. As shown in FIG. 1, substantially U-shaped notches 20 are formed at the front edges of the upper and lower parts of the surrounding wall 19 of the receptacle 13. The notches 20 receive the cam pins 31 during connection with the male housing 30.

Figure 3:
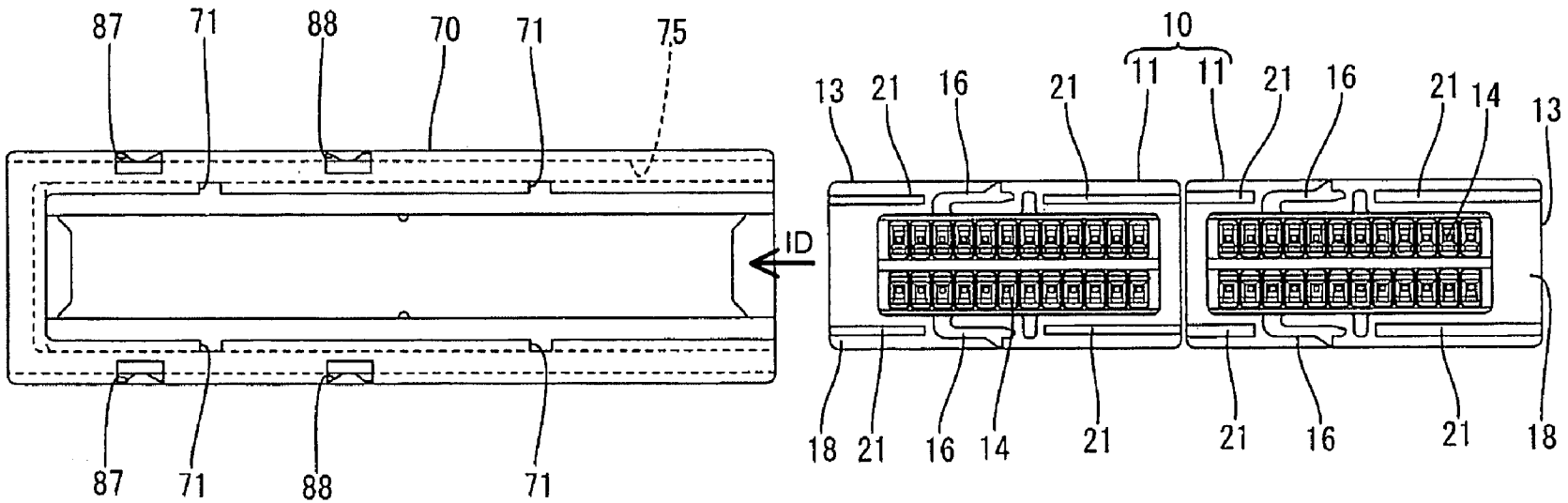
FIG. 3 is a rear view showing the frame and the auxiliary housings.

As shown in FIG. 3, guides 21 are formed on the rear surface of the standing wall 18 of the receptacle 13 and extend along an inserting direction ID into the frame 70. The guides 21 slide in engagement with guidable portions 72 in the frame 70, as shown in FIG. 10, to ensure insertion stability of each auxiliary housing 11 into the frame 70. As shown in FIG. 3, the guides 21 differ in thickness or width between the two auxiliary housings 11. Specifically, the guides 21 of the auxiliary housing 11 inserted first into the frame 70 are narrower than those of the auxiliary housing 11 inserted later into the frame 70. In conformity with these guides 21, the guidable portions 72 at the back side of the frame 70 and corresponding to the auxiliary housing 11 inserted first are narrow grooves. The guidable portions 72 close to the insertion opening of the frame 70 and corresponding to the auxiliary housing 11 inserted later are wide grooves. Thus, if the auxiliary housing 11 that should be inserted later into the frame 70 inadvertently is inserted first, the wide guides 21 cannot be inserted into the narrow grooves at the back side of the frame 70. Hence, an assembling order of the auxiliary housings 11 cannot be reversed.

The male housing 30 is made e.g. of a synthetic resin and has a main body 34 substantially in the form of a wide block. Left and right receptacles 32 are arranged on the front surface of the main body 34. The left and right receptacles 32 are so provided as to substantially conform to the two auxiliary housings 11, and are integrally or unitarily united at a widthwise middle portion of the housing main body 34. The one or more cam pins 31 engageable with the cam grooves 51 formed in the slider 50 at least partly project at the leading ends of the upper and lower walls of the respective receptacles 32. Each cam pin 31 includes a cylindrical main portion 31A and a head portion 31B having a larger diameter than the main portion 31A. The cam pins 31 are provided at different positions in the left and right receptacles 32. Specifically, the cam pins 31 are provided at transversely displaced position with respect to each other, e.g. at substantially transversely middle positions in the right receptacle 32 of FIG. 14 while being provided at positions slightly displaced to laterally or right from transversely middle positions in the left receptacle 32. This prevents an error connection with the respective auxiliary housings 11.

Figure 2:
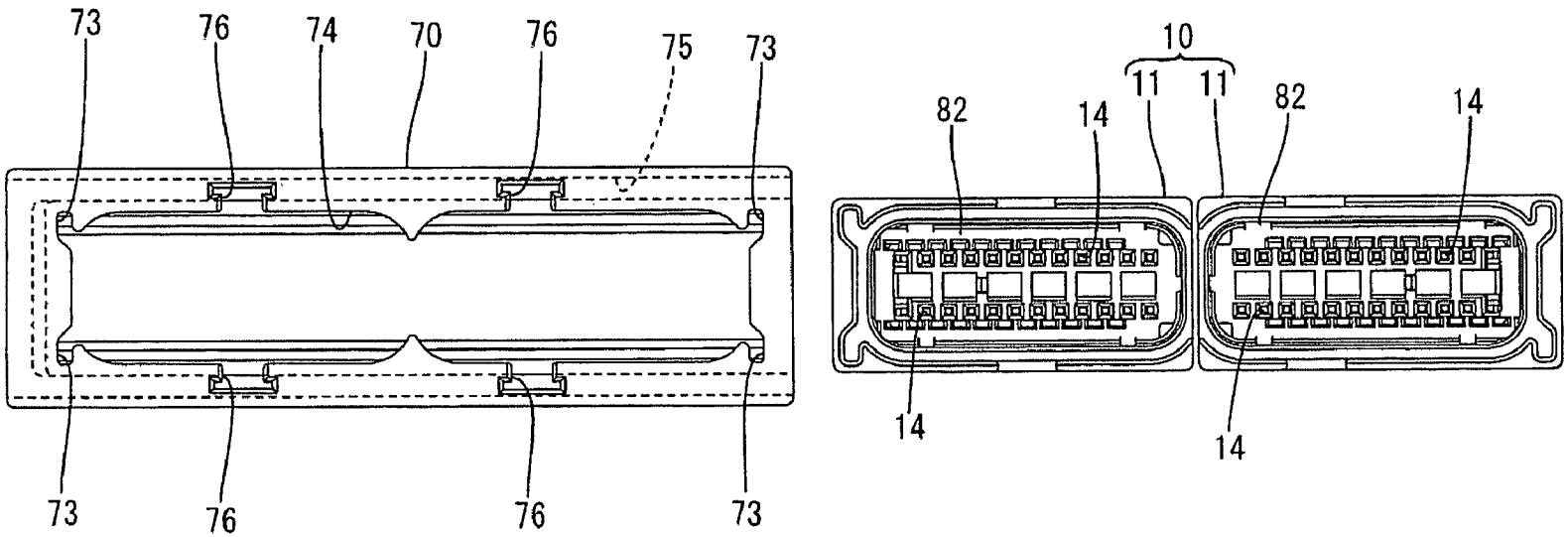
FIG. 2 is a front view showing the frame and the auxiliary housings.
Figure 14:
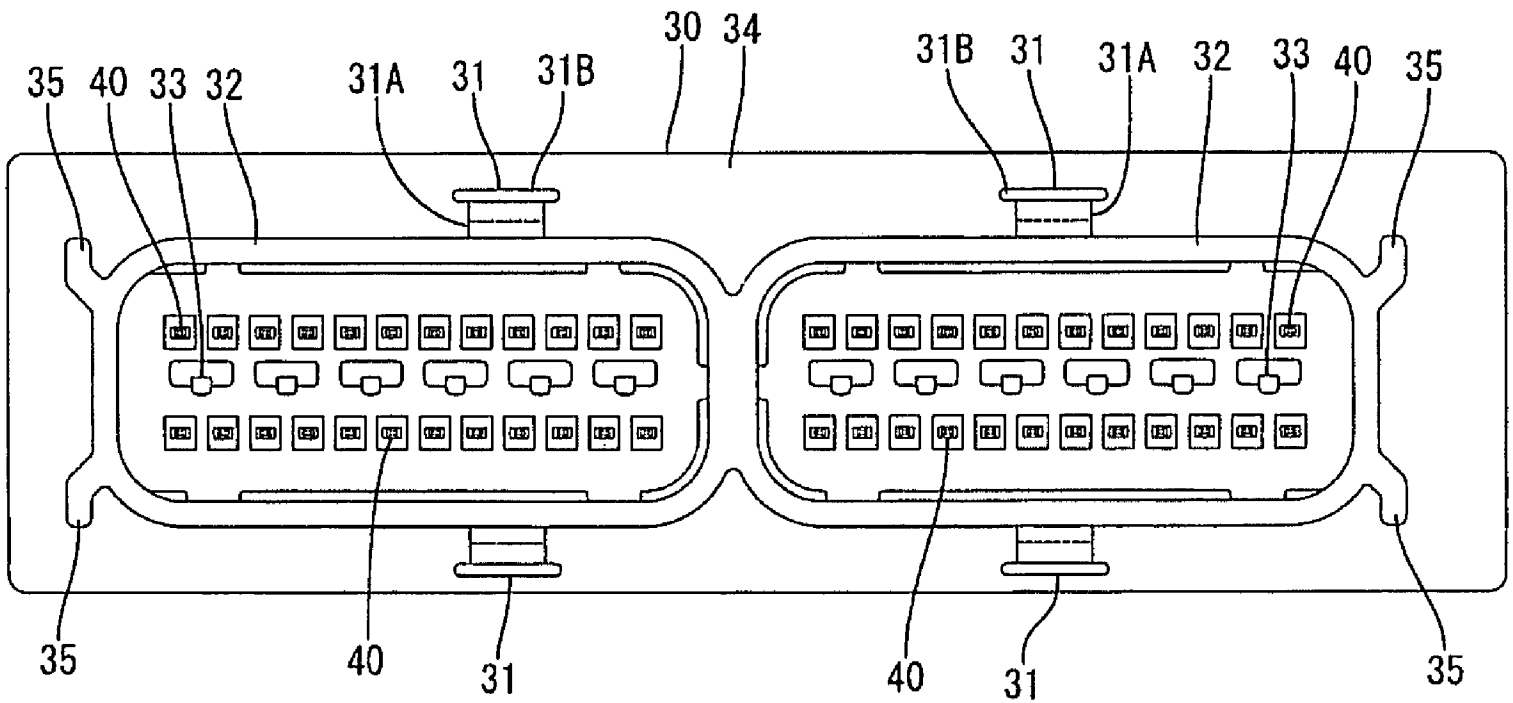
FIG. 14 is a plan view of the male housing.

Tabs 40 of male terminal fittings project from the main body 34 into the receptacles 32 of the male housing 30. The tabs 40 are arranged at upper and lower stages to substantially correspond to the mating female terminal fittings. Insulating disengaging pieces 33 project between the two stages. The disengaging pieces 33 enter the shorting-terminal mount holes 15 as the male housing 30 is connected with the respective auxiliary housings 11, thereby engaging the respective shorting terminals 80 to cancel the shorted state. As shown in FIG. 14 projections 35 project substantially vertically at four corners of the united receptacles 32. As shown in FIG. 2, the frame 70 is formed with guiding grooves 73 shaped substantially in conformity with the projections 35. Thus, the male housing 30 can be connected without being displaced by fitting the projections 35 into the guiding grooves 73.

Figure 5:
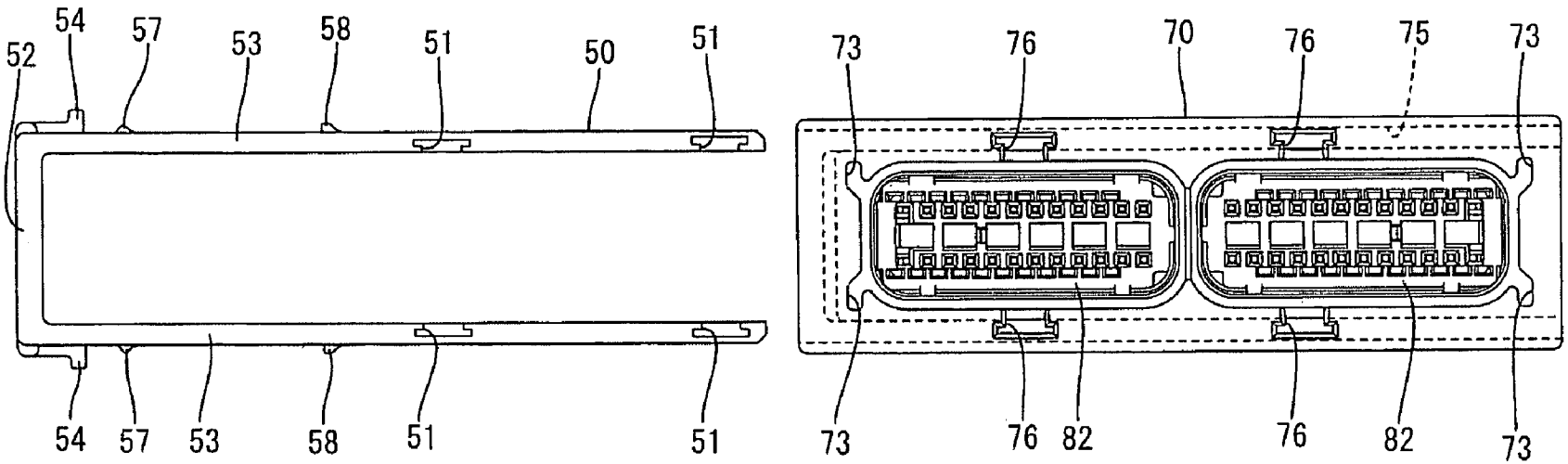
FIG. 5 is a front view showing the slider and the frame having the auxiliary housings accommodated therein.

The slider 50 also is made e.g. of a synthetic resin. The slider 50 has a base 52 and two slider main portions 53 project from opposite ends of the base 52. Thus, the slider 50 is gate-shaped, as shown in FIG. 5. Grips 54 are provided at portions coupling the opposite ends of the base 52 and the main portions 53 and are configured to be gripped easily by the hand and fingers of an operator. Cam grooves 51 are provided at two transversely displaced positions of each slider main portion 53 and are engageable with the corresponding cam pins 31 of the male housing 30. Each cam groove 51 has a guiding portion 54, a terminus portion 55 and a starting portion 56. The guiding portion 54 preferably is inclined at an angle of about 45° or smaller to the operating direction OD of the slider 50. The terminus portion 55 is substantially continuous with the bottom end of the guiding portion 54 and extends substantially parallel to the operating direction OD of the slider 50. The starting end portion 56 is substantially continuous with the upper end of the guiding portion 54 and extends substantially normal to the front edge of the slider main portion 53.

First and second locks 57, 58 are provided at two transversely displaced positions of a rear side of each slider main portion 53 for holding the slider 50 in the frame 70. The first lock 57 is close to the base 52 and the second lock 58 is distanced from the base 52. The respective locks 57, 58 preferably have the substantially same shape and same size and are formed by making U-shaped cuts in thinner portions of the slider main portion 53. Thus, the locks 57, 58 are cantilevered and are resiliently deformable. The locks 57, 58 are on substantially the same axis extending along the operating direction OD of the slider 50 into the frame 70. A locking projection 59 is provided at the extending end of each lock 57, 58. The locking projections 59 are resiliently engageable with first and second engaging portions 87, 88 in the frame 70.

As shown in FIGS. 2 and 3, the frame 70 preferably is substantially in the form of a box having openings in the front, rear and right surfaces. The opening in the front surface of the frame 70 is shaped to substantially correspond to the front surfaces of the receptacles 32 of the male housing 30 as shown in FIG. 2, and serves as an insertion opening for the male housing 30 inserted from the front. On the other hand, the opening in the right surface of the frame 70 is shaped to substantially conform to the side surfaces of the respective auxiliary housings 11, and serves as an insertion opening for the auxiliary housings 11 inserted in the inserting direction ID from right side. Wires (not shown) secured to the female terminal fittings are drawn out through the opening in the rear surface of the frame 70.

As shown in FIG. 10, the frame 70 has a housing accommodating space 74 for receiving the male housing 30 and the auxiliary housings 11. The frame also has a slider accommodating space 75 for receiving the slider 50. The slider accommodating space 75 opens in the left surface of the frame 70 and hence substantially opposite from the insertion opening for the auxiliary housings 11. As shown in FIGS. 1 and 4, a substantially U-shaped escaping slot 77 is formed in each of upper and lower outer walls 86 of the frame 70 defining the slider accommodating space 75 and communicate with the insertion opening for the slider 50. The hand and fingers gripping the slider 50 can escape into the escaping slots 77 while pushing the slider 50 into the frame 70. As shown in FIG. 10, inner walls 78 separate the slider accommodating space 75 and the housing accommodating space 74. The inner walls 78 are rendered discontinuous along forward and backward directions FBD by thinned portions 79.

As shown in FIG. 3, the outer walls 86 of the frame 70 defining the slider accommodating space 75 have first and second engaging portions 87, 88 for engaging the first and second locks 57, 58 of the slider 50. The first engaging portions 87 are close to the insertion opening for the slider 50 in the frame 70, whereas the second engaging portions 88 are distanced from the insertion opening for the slider 50 in the frame 70. The engaging portions 87, 88 are recesses in the outer walls 86 that receive the locking projections 59 of the respective locks 57, 58. The engaging portions 87, 88 open to the rear surface of the frame 70 for removal of the mold that forms the engaging portions 87, 88.

The walls of the slider accommodating space 75 press the locking projections 59 while the slider 50 is being pushed in the operating direction OD. Thus, the second locks 58 deform resiliently towards the housing accommodating space 74. However, the second locks 58 are restored resiliently when the locking projections 59 fit into the first engaging portions 87, as shown in FIG. 8. At this partial locking position, the slider 50 is kept so as not to move relative to the frame 70 and the cam grooves 51 of the slider 50 align with cam guiding grooves 76 of the frame 70.

Figure 9:
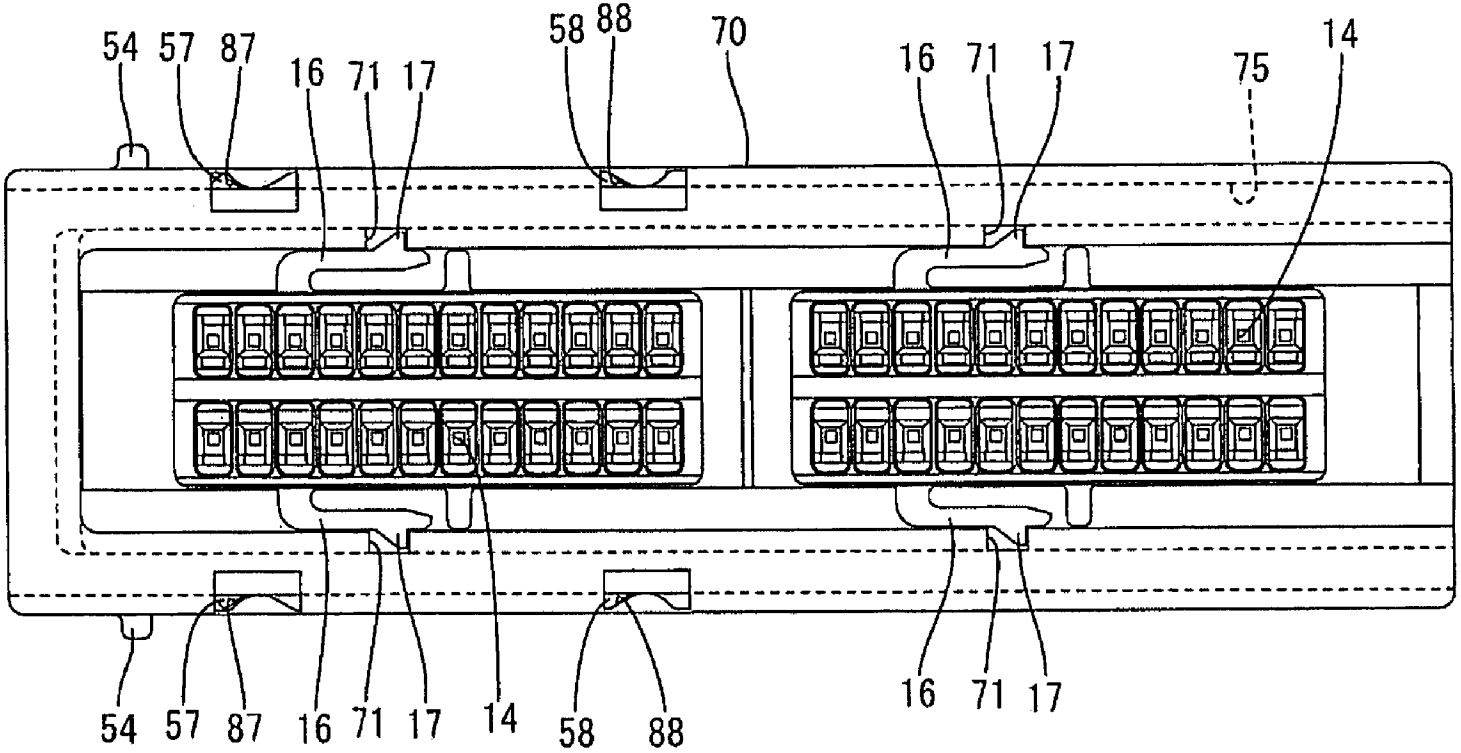
FIG. 9 is a rear view showing the slider at a full locking position.

The second locks 58 deform again and disengage from the first engaging portions 87 when the slider 50 is pushed further in the operating direction OD from the partial locking position. However, the second locks 58 are restored resiliently upon reaching positions corresponding to the second engaging portions 88, as shown in FIG. 9. The first locks 57 also deform when the second locks 58 deform, and are restored resiliently upon reaching the first engaging portions 87 when the second locks 58 reach the positions the second engaging portions 88. At this full locking position, the slider 50 is held strongly in the frame 70, and the male housing 30 is connected properly with the respective auxiliary housings 11 by the cam action of the slider 50.

As shown in FIG. 2, the frame 70 has cam guiding grooves 76 that penetrating the inner walls 78. The cam guiding grooves 76 open in the front surface of the frame 70 to communicate the housing accommodating space 74 and the slider accommodating space 75. The cam grooves 51 of the slider 50 face the housing accommodating space 74 through the cam guiding grooves 76 and are engageable with the cam pins 31.

As shown in FIG. 4, receiving portions 71 open in the rear surface of the frame 70 and communicate with the housing accommodating space 74. The inner surfaces of the inner walls 78 press the locks 16 of the auxiliary housing 11 and deform the locks 16 as each auxiliary housing 11 is accommodated in the frame 70. The locks 16 are restored resiliently when the auxiliary housing 11 reaches a proper mount position. Thus, the lock projections 17 fit into the receiving portions 71, and the auxiliary housing 11 is retained in the frame 70. As shown in FIG. 4, the receiving portions 71 at the right side have a shorter depth than those at the left side. Thus, the lock projections 17 of the auxiliary housing 11 inserted first cannot be fit therein inadvertently, as described above.

As shown in FIG. 10, the guidable portions 72 project from the inner walls 78 of the frame 70 towards the housing accommodating space 74. The guidable portions 72 extend substantially along a transverse direction on the upper and lower inner walls 78 of the frame 70, and are formed with guiding grooves 72A at positions corresponding to the guides 21 of the respective auxiliary housings 11. The respective auxiliary housings 11 are guided to the proper mount positions substantially along the guidable portions 72 with the guides 21 engaged with the guiding grooves 72A.

The inner walls 78 of the frame 70 have thinned portions 79 that communicate with the housing accommodating space 74 and the slider accommodating space 75, as shown in FIG. 10. Specifically, the thinned portions 79 are adjacent the guidable portions 72 and substantially correspond to the receptacles 13 of the auxiliary housings 11. The thinned portions 79 extend substantially in the transverse direction so that the surrounding walls 19 of the receptacles 13 fit therein. The surrounding walls 19 enter the thinned portions 79 and are exposed to the slider accommodating space 75. Outer surfaces of the slider main portions 53 are along these exposed parts, as shown in FIG. 10. The surrounding walls 19 of the receptacles 13 enter the thinned portions 79 and become substantially continuous with and flush with the inner walls 78 of the frame 70. In other words, the outer surfaces of the surrounding walls 19 of the frame 70 are substantially flush with the outer surfaces of the inner walls 78 that define the slider accommodating space 75. Additionally, the inner surfaces of the surrounding walls 19 of the receptacles 13 are substantially flush with the inner surfaces of the inner walls 78 that define the housing accommodating space 74.

Figure 6:
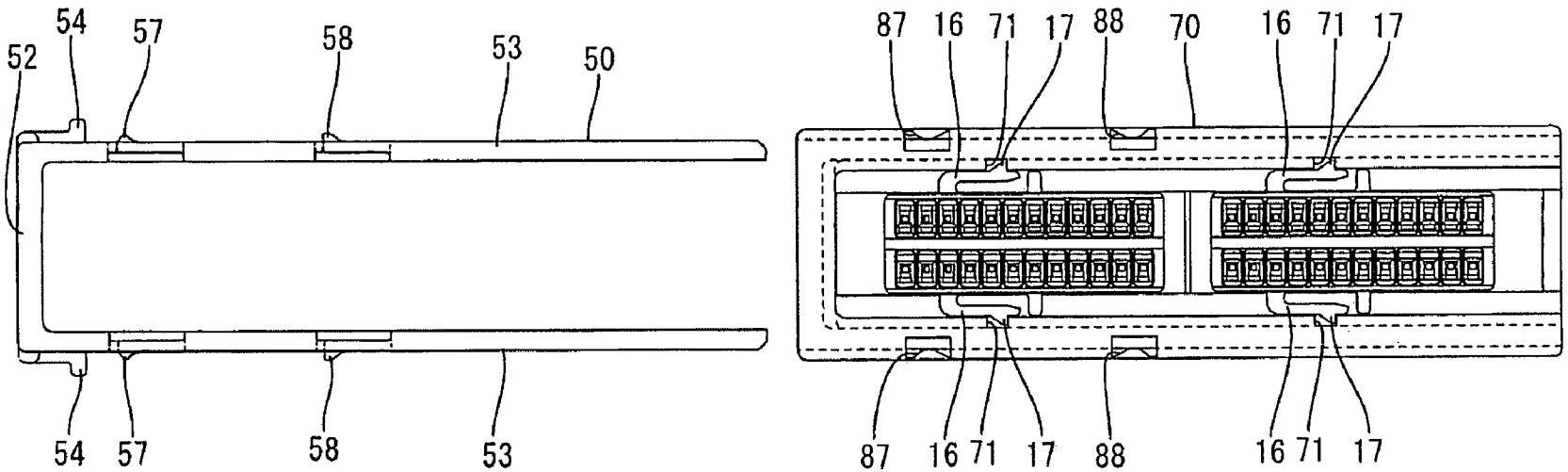
FIG. 6 is a rear view showing the slider and the frame having the auxiliary housings accommodated therein.

The connector is assembled by inserting the female terminal fittings into the respective auxiliary housings 11, and inserting the male terminal fittings into the male housing 30. As shown in FIGS. 4 to 6, the respective auxiliary housings 11 are inserted sideways and along the inserting direction ID into the housing accommodating space 74 of the frame 70. More particularly, the auxiliary housings 11 are slid along the guidable portions 72 with the receptacles 13 of the auxiliary housings 11 aligned with the thinned portions 79 of the frame 70. The auxiliary housing 11 inserted first has the locks 16 engaged with the receiving portions 71 at the back side of the frame 70, whereas the auxiliary housing 11 inserted later has the lock portions 16 engaged with the receiving portions 71 near the insertion opening of the frame 70. In this way, the outer surfaces of the surrounding walls 19 of the receptacles 13 are substantially exposed toward the slider accommodating space 75.

The slider 50 is inserted into the slider accommodating space 75 of the frame 70 in the operating direction OD and from the side opposite from the inserting side of the auxiliary housings 11. As shown in FIGS. 7 and 8, the slider 50 is held at the partial locking position by the engagement of the second locks 58 and the first engaging portions 87 of the frame 70. At this time, the starting end portions 56 of the cam grooves 51 of the slider 50 are aligned with the cam guiding grooves 76 of the frame 70.

Figure 12:
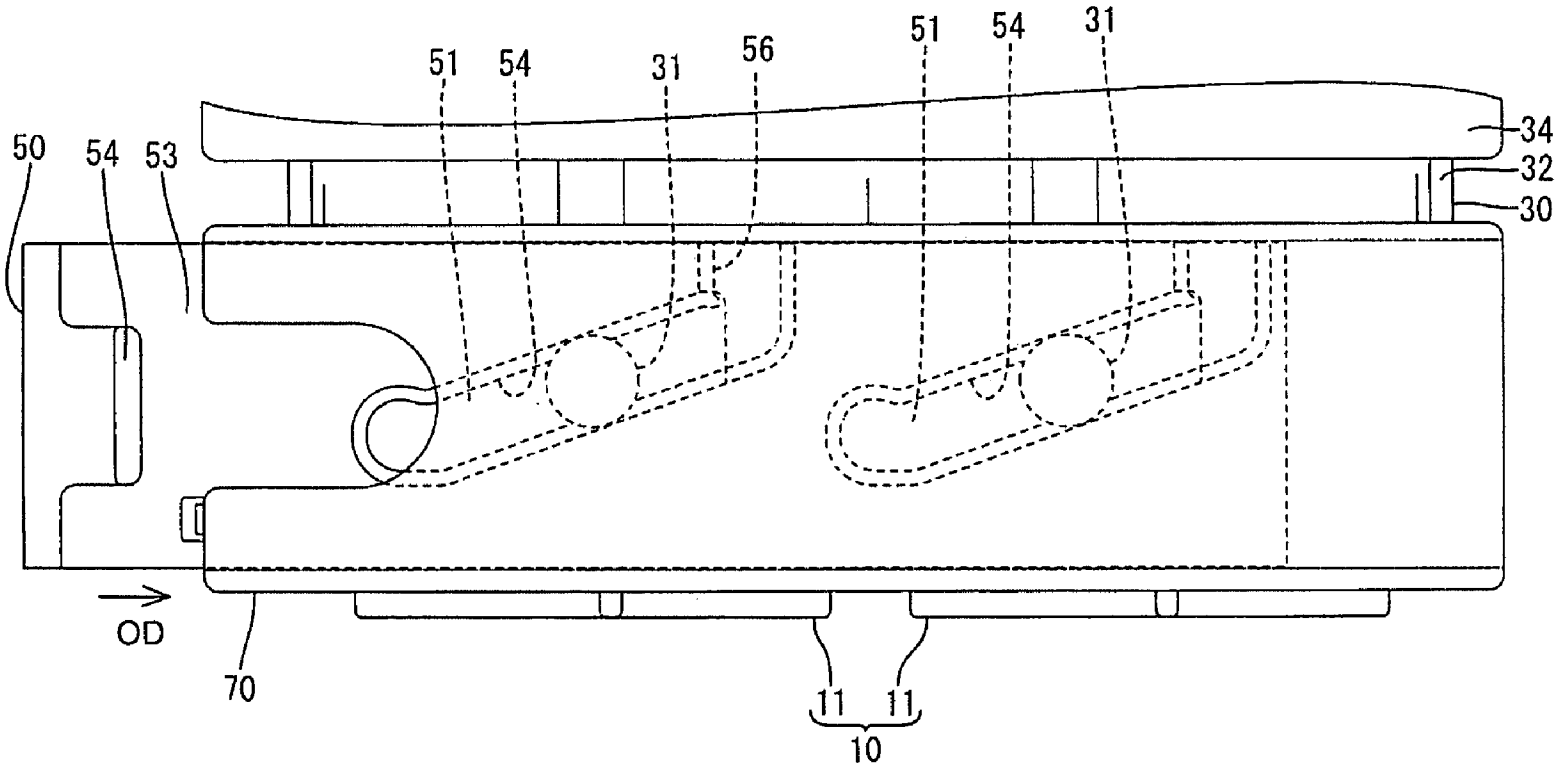
FIG. 12 is a plan view showing an intermediate stage of the connection of the male housing.

The male housing 30 then is inserted loosely into the frame 70 from the front while aligning the projections 35 with the guiding grooves 73. Thus, the cam pins 31 enter the starting end portions 56 of the cam grooves 51 of the slider 50 while facing the cam guiding grooves 76. The grips 54 of the slider 50 then are gripped to push the slider 50 in the operating direction OD, as shown by the arrow in FIG. 12. The cam pins 31 move substantially along the cam grooves 51, as shown in FIG. 12, as the slider 50 is pushed. As a result, the male housing 30 enters the housing accommodating space 74 of the frame 70 by means of the cam action. At this time, the slider main portions 53 of the slider 50 are arranged along the outer surfaces of the surrounding walls 19 of the receptacles 13.

Figure 13:
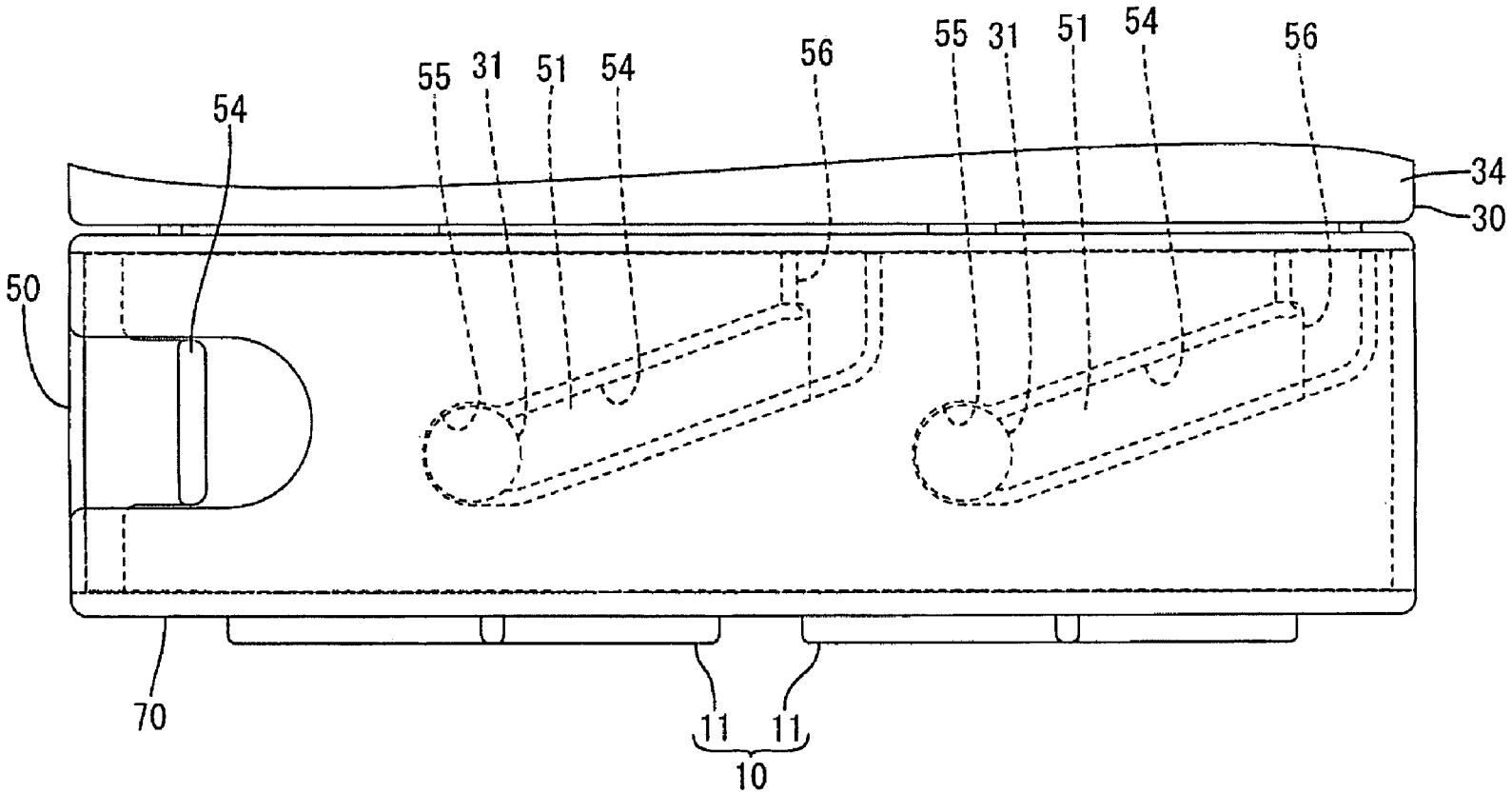
FIG. 13 is a plan view showing the male housing properly connected.

The slider 50 is pushed further in the operating direction OD. Thus, the cam pins 31 move in the guiding portions 54 of the cam grooves 51 to progress the connection, and the leading ends of the receptacles 32 of the male housing 30 are inserted between the housing main bodies 12 and the receptacles 13 of the respective auxiliary housings 11 to provide sealing. The cam pins 31 pass the guiding portions 54 of the cam grooves 51 and reach the terminus portions 55 as shown in FIG. 13. Thus, the connection stops and the male housing 30 is connected properly with the auxiliary housings 11. In this substantially properly connected state, the female and male terminal fittings are connected electrically with each other. Further, the slider main portions 53 of the slider 50 and the surrounding walls 79 of the receptacles 13 of the auxiliary housings 11 are near each other while defining tiny clearances therebetween.

As described above, the thinned portions 79 at least partly penetrate the inner walls 78 of the frame 70, and the receptacles 13 of the respective auxiliary housings 11 enter the thinned portion 79. Thus, the surrounding walls 19 of the receptacles 13 come into proximity to the main portions 53 of the slider 50, and the height of the connector can be shortened by as much as the thickness of the inner walls 78.

The entry of the receptacles 13 of the auxiliary housings 11 into the thinned portions 79 makes the outer surfaces of the surrounding walls 19 of the receptacles 13 and the outer surfaces of the inner walls 78 substantially flush with each other. Thus, the slider accommodating space 75 can be formed into a bag-shaped or U-shaped channel as the auxiliary housings 11 are inserted, thereby improving the insertion stability of the slider 50.

The entry of the receptacles 13 of the auxiliary housings 11 into the thinned portions 79 also makes the inner surfaces of the surrounding walls 19 of the receptacles 13 and the inner surfaces of the inner walls 78 substantially flush with each other. Thus, the inner walls 78 can also function as the receptacles 13. In other words, a large receptacle area is formed by the receptacle 13 and the inner walls 78 for covering substantially the entire front side of the main body 12. Thus, the male housing 30 can move smoothly from the inner walls 78 toward the receptacles 13.

The invention is not limited to the above described and illustrated embodiment. For example, the following embodiment is also embraced by the technical scope of the present invention as defined by the claims. Beside the following embodiment, various changes can be made without departing from the scope and spirit of the present invention as defined by the claims.

Although each thinned portion penetrates the inner wall in the foregoing embodiment, it may be a recess or notch formed in the inner surface of the inner wall by cutting away a part of the inner wall along thickness direction.

The inner walls remain after forming the thinned portions in the foregoing embodiment. However, the thinned portions may remove the entire inner walls.

The slider main portions and the receptacles are near each other in the foregoing embodiment, but they may contact each other.

The receptacles enter the thinned portions in the foregoing embodiment. However, parts of the outer walls of the housing main bodies may enter the thinned portions.

The female housing is inserted sideways into the frame in the foregoing embodiment, but it may be inserted into the frame from the front, from behind or from any other direction.

The movable member is a slider that is linearly movable in the preceding embodiment. However, the movable member may be a slider that moves along a non-linear path or a lever that is pivotably or rotatably provided on the frame.

What is claimed is:

1. A connector, comprising:

a frame having a housing accommodating space, a movable member accommodating space extending in a transverse direction on the frame and an inner wall between the housing accommodating space and the movable member accommodating space, the inner wall being formed with at least one groove extending in the transverse direction;

a movable member mounted movably in the movable member accommodating space for movement substantially in the transverse direction;

a first housing mounted in the housing accommodating space of the frame, the first housing having an outer wall configured for entering the groove and substantially contacting the movable member; and a second housing engaging the movable member in the movable member accommodating space so that the second housing is connectable with the first housing in response to movement of the movable member in the movable member accommodating space.

2. The connector of claim 1, wherein the movable member has at least one cam substantially facing the housing accommodating space, the second housing having at least one mating cam configured for engaging the cam of the movable member, connection of the second housing with the first housing being assisted by movement of the movable member at an angle to a connecting direction of the housings.

3. The connector of claim 2, wherein the movable member is a slider.

4. The connector of claim 1, wherein the groove penetrates the inner wall, the outer wall of the first housing and the inner wall being substantially flush with each other at surfaces defining the movable member accommodating space.

5. The connector of claim 1, wherein the first housing has a receptacle for receiving the second housing.

6. The connector of claim 5, wherein the receptacle has at least one surrounding wall defining an outer wall of the first housing.

7. The connector of claim 6, wherein the surrounding wall of the receptacle and the inner wall of the frame are substantially flush with each other at surfaces defining the housing accommodating space.

8. The connector of claim 1, wherein the first housing comprises at least two auxiliary housings that are insertable into the frame.

9. The connector of claim 8, wherein at least one guide is provided on each of the auxiliary housings and extends substantially along an inserting direction of the auxiliary housings into the frame, the guide being engageable with at least one guidable portion in the frame.

10. The connector of claim 9, wherein the at least one guide comprises guides on each of the auxiliary housings, and wherein the auxiliary housing are progressively wider in accordance with an insertion order of the auxiliary housings into the frame.

11. The connector of claim 10, wherein the guidable portions are grooves that are progressively wider in accordance with an insertion order of the auxiliary housings into the frame.

12. A connector, comprising:

a frame having opposite front and rear ends and opposite first and second sides, a housing accommodating space open into the first side of the frame, a slider accommodating space open into the second side of the frame and an inner wall between the housing accommodating space and the slider accommodating space, the inner wall being formed with at least one opening extending from the first side towards the second side and providing communication between the housing accommodating space and the slider accommodating space;

a slider mounted movably in the slider accommodating space;

a first housing mounted in the housing accommodating space of the frame, the first housing having an outer wall configured for entering the opening in the inner wall of the frame; and a second housing configured for entering the front end of the frame and contacting the slider in the slider accommodating space, the second housing being connectable with the first housing in response to movement of the slider in the slider accommodating space.

13. The connector of claim 12, wherein the slider has at least one cam substantially facing the housing accommodating space the second housing having at least one mating cam configured for engaging the cam of the slider, connection of the second housing with the first housing being assisted by movement of the slider at an angle to a connecting direction of the housings.

14. The connector of claim 13, wherein the outer wall of the first housing and the inner wall are substantially flush with each other at surfaces defining the slider accommodating space.

15. The connector of claim 14, wherein the first housing has a receptacle for receiving the second housing.

16. The connector of claim 15, wherein the receptacle has at least one surrounding wall defining an outer wall of the first housing.

17. The connector of claim 16, wherein the surrounding wall of the receptacle and the inner wall of the frame are substantially flush with each other at surfaces defining the housing accommodating space.

18. The connector of claim 17, wherein the first housing comprises at least two auxiliary housings that are insertable into the frame.

* * * * *